US005865713A

United States Patent [19]

Hsu

[11] Patent Number: 5,865,713

[45] Date of Patent: Feb. 2, 1999

[54] MULTIPURPOSE EXERCISE DEVICE

[76] Inventor: Hank Hsu, 8F-14, No. 16, Lane 609, Sec. 5, Chung Hsin Rd., Sanchung, Taipei, Taiwan

[21] Appl. No.: 863,011

[22] Filed: May 23, 1997

[51] Int. Cl.[6] ..... A63B 23/04

[52] U.S. Cl. ..... 482/72; 482/96

[58] Field of Search ..... 482/72–74, 112, 482/113, 95, 96

[56] References Cited

U.S. PATENT DOCUMENTS

| | | | |
|---|---|---|---|
| 1,750,549 | 3/1930 | Thomson et al. | 482/72 |
| 1,866,860 | 7/1932 | Pareira | 482/72 |
| 1,866,868 | 7/1932 | Thomson et al. | 482/72 |
| 1,905,092 | 4/1933 | Hardy | 482/72 |
| 1,994,593 | 3/1935 | Schmidt | 482/72 |

*Primary Examiner*—Jerome Donnelly
*Attorney, Agent, or Firm*—Browdy and Neimark

[57] ABSTRACT

An exercise machine is intended for use in developing the muscles of arms, legs and waist, and is composed of a base, a movable plate, a damping mechanism, driving mechanism, a seat, and a grip. The damping mechanism comprises a plurality of elastic members for providing adjustably the exercise machine with various damping effects. The driving mechanism comprises a traction cable which is fastened at one end thereof with the grip and at another end thereof with the slide member so as to enable the user of the exercise machine to do various exercises.

9 Claims, 4 Drawing Sheets

MULTIPURPOSE EXERCISE DEVICE

FIELD OF THE INVENTION

The present invention relates generally to an exercise device, and more particular to a rowing exercise device.

BACKGROUND OF THE INVENTION

As shown in FIG. 1, a rowing exercise machine 1 of the prior art is composed of a base 2, two pedals 3 fastened pivotally with one end of the base 2, two oil-pressure rods 4 fastened pivotally at one end thereof with the base 2, two slide rods 5 fastened pivotally with the oil-pressure rods 4 such that the slide rods 5 are slidable on the base 2, and a seat 6 fastened with another end of the base 2 such that the seat 6 is opposite to the pedals 3. The rowing exercise is brought about by a person who is seated on the seat 6, with his or her hands holding the slide rods 4 and with his or her feet pressing against the pedals 3. In other words, the rowing exercise machine 1 of the prior art is intended for use by a person to develop the muscles of arms and legs of the person.

Such a prior art rowing exercise machine as described above is defective in design in that the damping effect of the oil-pressure rods 4 can not be adjusted to suit the physical conditions of an exerciser. As a result, the prior art rowing exercise machine is rather limited in use.

SUMMARY OF THE INVENTION

The primary objective of the present invention is to provide an exercise machine with a damping effect which can be adjusted by its user.

Another objective of the present invention is to provide an exercise machine which can be used to build the muscles of arms, legs and waist.

In keeping with the principle of the present invention, the foregoing objectives of the present invention are attained by the exercise machine, which consists of a base, a movable plate, a damping mechanism, a driving mechanism, a seat, and a handle. The damping mechanism comprises a plurality of elastic members for providing adjustably the exercise machine with various damping effects. The elastic members are fastened with a slide member driven by the driving mechanism. The handle is fastened with the driving mechanism.

The foregoing objectives, features and functions of the present invention will be more readily understood upon a thoughtful deliberation of the following detailed description of the present invention with reference to the accompanying drawings.

DETAILED DESCRIPTION OF THE INVENTION

Figure 1:
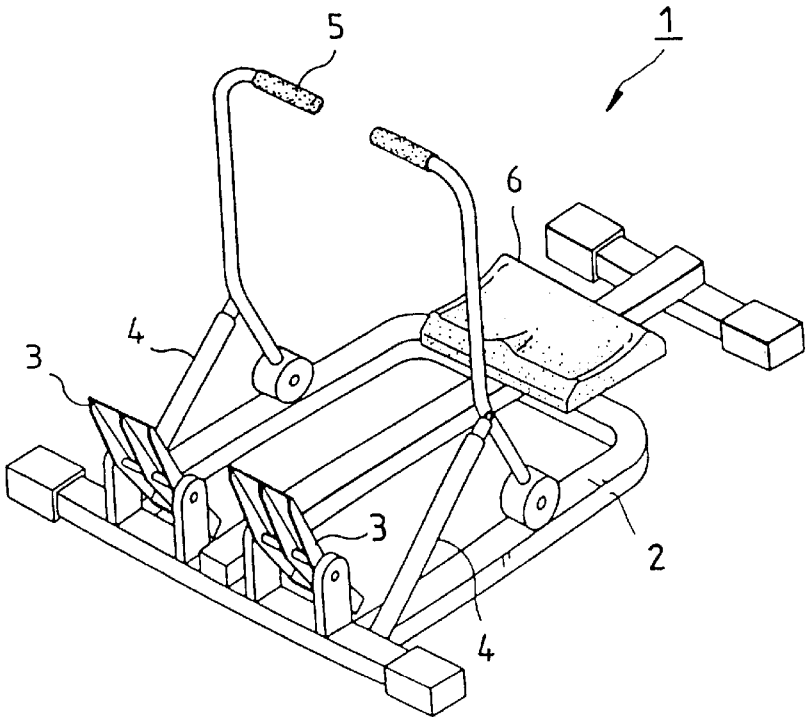
FIG. 1 PRIOR ART
FIG. 1 shows a perspective view of a rowing exercise machine of the prior art.
Figure 2:
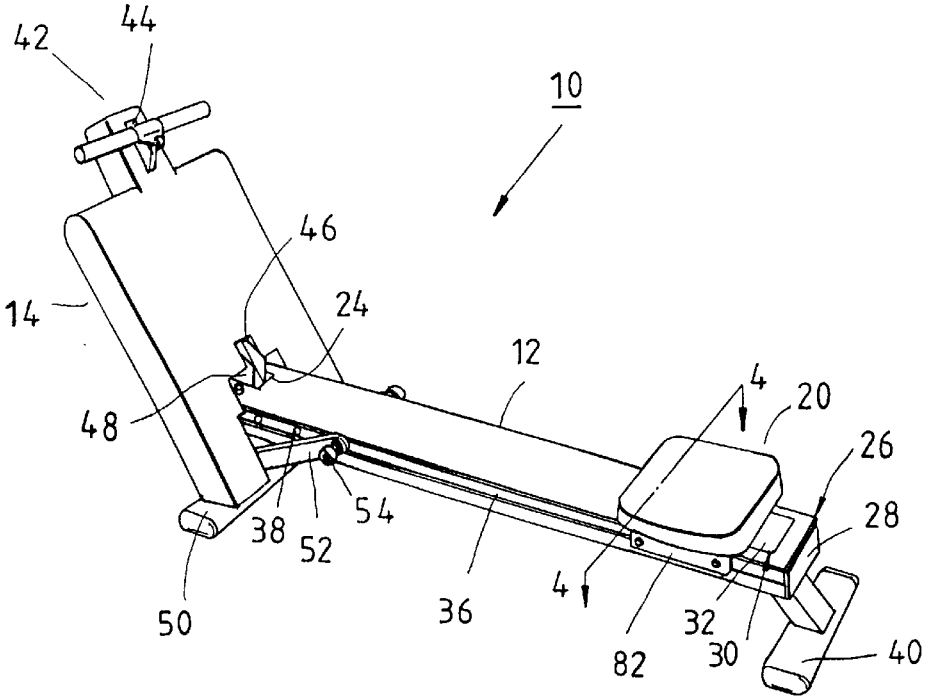
FIG. 2 shows a perspective view of an exercise machine of the present invention.
Figure 3:
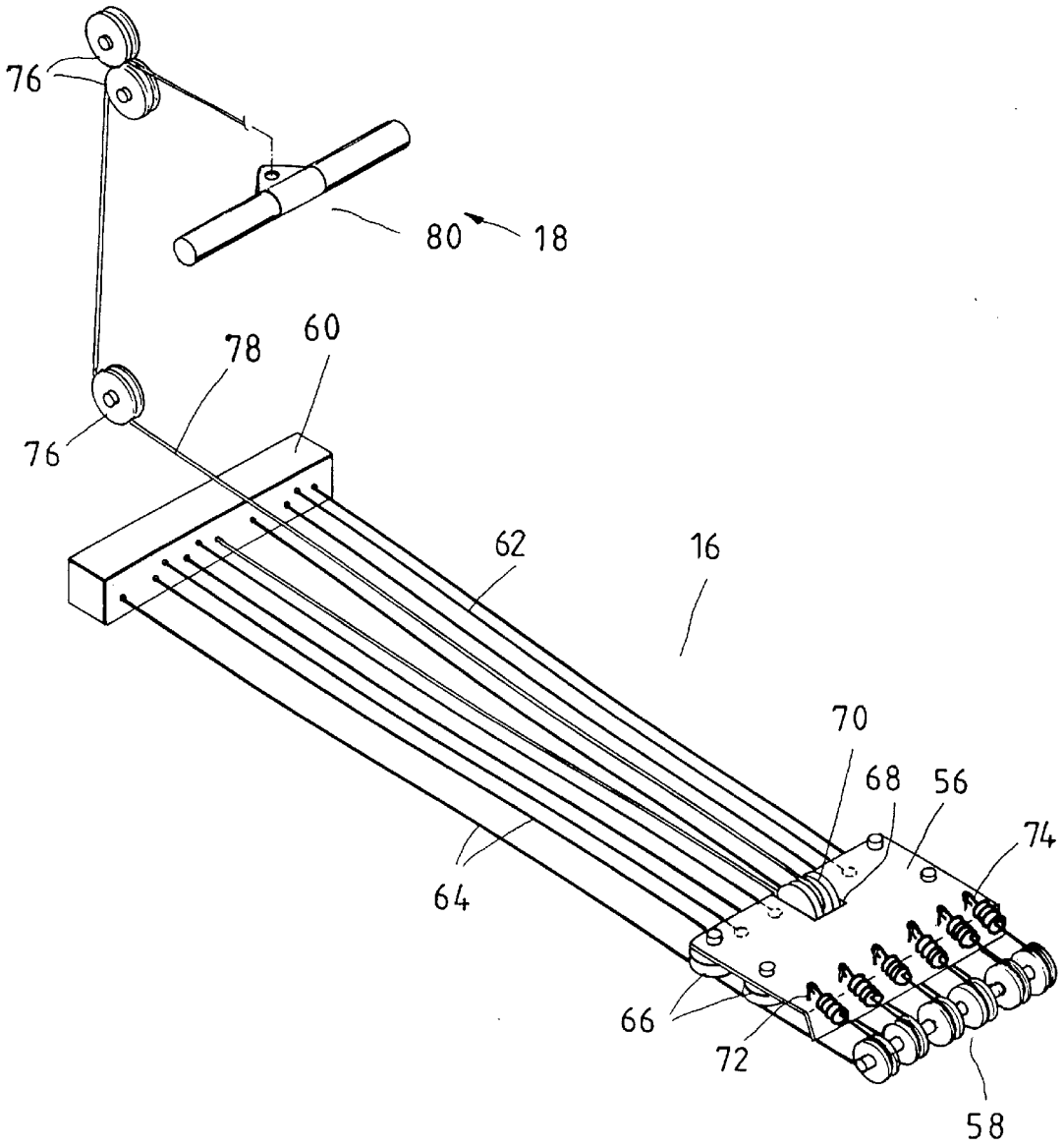
FIG. 3 shows a partial schematic view of the exercise machine of the present invention.
Figure 4:
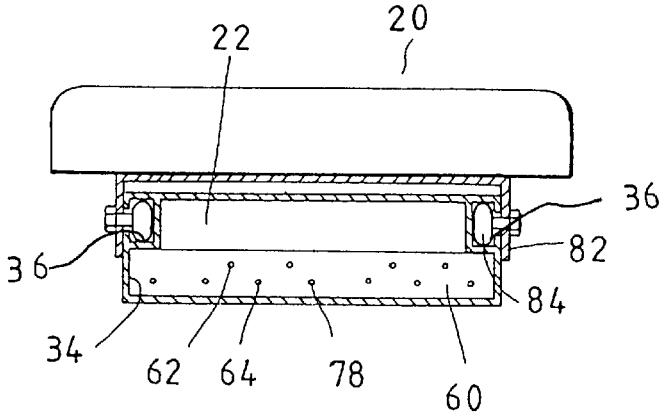
FIG. 4 shows a sectional view of a portion taken along the direction indicated by a line 4—4 as shown in FIG. 2.

As shown in FIGS. 2–4, an exercise machine 10 embodied in the present invention is composed of a base 12, a movable plate 14, a damping mechanism 16, a driving mechanism 18, and a seat 20.

The base 12 is rectangular in shape and is provided with a receiving space 22 which houses damping mechanism 16 therein, an opening 24, a receiving port 26, a cover plate 28, a mouth 30 provided with a movable cover 32, two first slide rails 34, two second slide rails 36, a plurality of locating holes 38, and a bracing seat 40.

The movable plate 14 has a receiving space (not shown in the drawing), a receiving portion 42 provided with a receiving cell 44 in communication with the receiving space, a cut 46 provided with an opening (not shown in the drawing) in communication with the receiving space. The movable plate 14 is fastened pivotally with the base 12 by means of a pivoting member 48. A bracing plate 50 is fastened with the movable plate 14 such that the bracing plate 50 is corresponding in location to the bracing seat 40. Two braking rods 52 are fastened pivotally with the movable plate 14 and are provided with a spring button 54 corresponding in location to and engageable with the locating holes 38.

The damping mechanism 16 housed in receiving space 22 consists of a slide member 56, a pulley set 58, a fastening block 60, a predetermined number of first elastic members 62 and second elastic members 64.

The slide member 56 is slidably mounted on the first slide rail 34 and is provided with an opening 68 in which a second pulley 70 is received. A predetermined number of retaining rings 72 are fastened with the slide member 56. The slide member 56 is provided with four first pulleys 66 fastened therewith.

The pulley set 58 is composed of pulleys equal in number to the retaining rings 72 and is fastened with the base 12.

The fastening block 60 is rectangular in shape and is fastened with the base 12 such that the fastening block 60 is corresponding in location to the pulley set 58 also located in receiving space 22.

The elastic members 62 and 64 are made of a rubber material. The first elastic member 62 is fastened with the slide member 56 and the fastening block 60. The second elastic members 64 are provided with a hook 74 engageable with the retaining rings 72 of the slide member 56. The second elastic members 64 are wound on the pulleys of the pulley set 58.

The driving mechanism 18 is made up of three third pulleys 76, a traction cable 78, and a grip member 80.

The third pulleys 76 are mounted in the receiving space and the receiving cells 44 of the receiving portion 42.

The traction cable 78 of a steel material is fastened at one end thereof with the fastening block 60. Thereafter another end of the cable 78 is wound on the second pulley 70 via the opening 68 before passing over the movable plate 14, around the third pulley 76, and into the receiving portion 42 where this end is fastened to grip 80.

The grip member 80 of a rodlike construction is fastened with the traction cable 78 such that the grip member 80 is located outside the receiving portion 42.

The seat 20 is supported by two frames 82 which are provided with four guide wheels 84 fastened therewith to enable the seat 20 to move on the base 12 in second slide rails 36.

Figure 5:
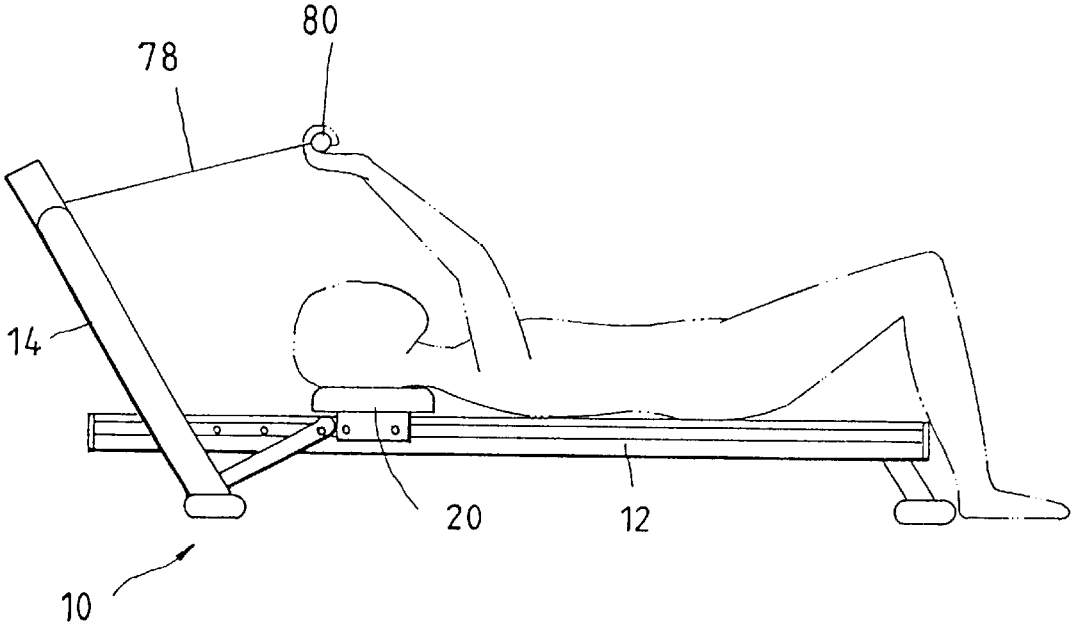
FIG. 5 shows a schematic view of the present invention at work.

As shown in FIG. 5, an exerciser lies on the base 12 such that both hands of the exerciser hold the grip member 80. As the grip member 80 is pulled to overcome the elastic force of the second elastic members 64, the slide member 56 is pulled by the traction cable 78 to move towards the movable plate 14 so as to allow the grip member 80 to be pulled in another direction. The pulling actions are repeated to develop the muscles of arms and the upper trunk.

Figure 6:
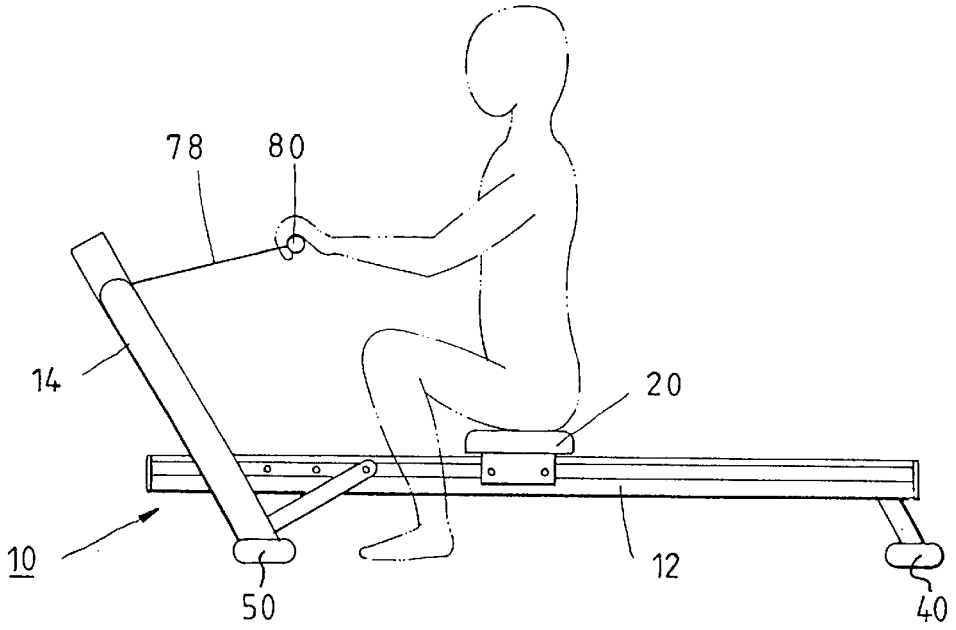
FIG. 6 shows another schematic view of the present invention at work.

As shown in FIG. 6, the exerciser is seated on the seat 20 for doing the exercise to build the muscles of arms and waist.

Figure 7:
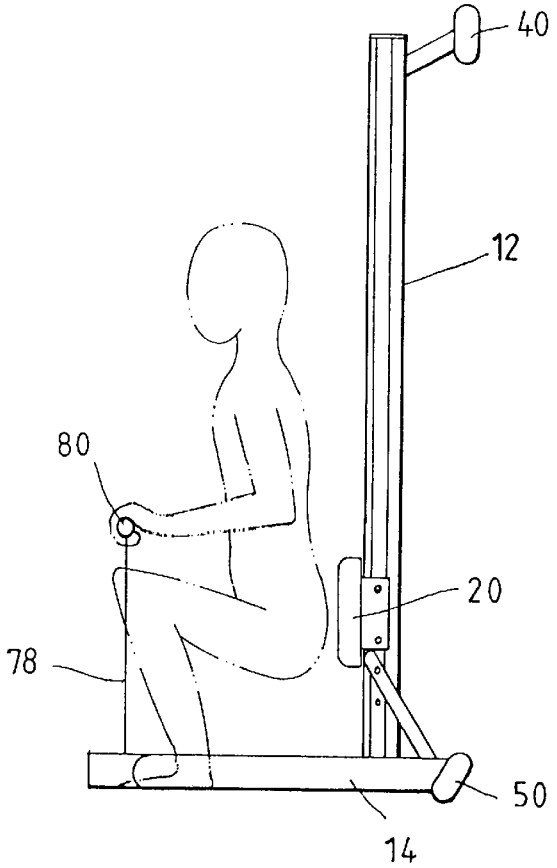
FIG. 7 shows still another schematic view of the present invention at work.

As shown in FIG. 7, the movable plate 14 is adjusted such that it is perpendicular to the base 12. The exerciser stands on the movable plate 14 such that both hands hold the grip member 80 to do a kneeling exercise for building the leg muscle.

The damping effect of the present invention is attained by the second elastic members 64 which are provided respectively with a hook 74 engageable with one of the retaining rings 72 of the slide member 56. As a result, the magnitude of the damping effect of the present invention can be easily adjusted by the user by unhooking a hook 74 through mouth 30 after movable cover 32 is removed. In addition, the braking rods 50 of the present invention can be located in the locating holes 36 so as to adjust the angle formed between the base 12 and the movable plate 14. As a result, the manner in which the present invention is used can be broadened easily. The exercise machine 10 of the present invention can be made compact to facilitate the storage of the exercise machine 10, thanks to the movable plate 14. It must be noted here that the grip member 80 may be a circular strap.

What is claimed is:

1. An exercise machine comprising:

a base provided with a plurality of locating holes separated from one another by a predetermined distance;

a movable plate fastened pivotally with said base and provided with a receiving space;

a damping mechanism comprising a slide member mounted slidably on said base, and a plurality of elastic members fastened with said slide member and said base;

a driving mechanism comprising a traction cable and a grip member fastened with one end of said traction cable which is in turn fastened at another end thereof with said slide member; and a seat mounted slidably on said base;

wherein said damping mechanism further comprises a pulley set having a plurality of pulleys; wherein said elastic members of said damping mechanism comprise a plurality of first elastic members and a plurality of second elastic members, said second elastic members provided respectively at one end thereof with a means for engaging said slide member, said second elastic members being respectively wound on said pulleys of said pulley set; and wherein said slide member has plurality of means for retaining said means for engaging said slide member.

2. The exercise machine as defined in claim 1, wherein said base is provided with two first slide rails extending along the direction of a longitudinal axis of said base to serve as tracks for said slide member, and two second slide rails extending along the direction of said longitudinal axis of said base to serve as tracks for said seat.

3. The exercise machine as defined in claim 2, wherein said slide member is provided with a plurality of first pulleys fastened pivotally therewith such that said first pulleys run on said first slide rails; and wherein said seat is provided with a plurality of guide wheels fastened therewith such that said guide wheels run on said second slide rails.

4. The exercise machine as defined in claim 1, wherein said movable plate is further provided at one end thereof with two braking rods which are fastened pivotally therewith and are provided respectively with a spring button engageable with said locating holes of said base.

5. The exercise machine as defined in claim 1, wherein said retaining means of said second elastic members are hooks; and wherein said retaining means of said slide member are rings.

6. The exercise machine as defined in claim 1, wherein said slide member is provided with a single pulley on which said another end of said traction cable is wound.

7. The exercise machine as defined in claim 1, wherein said driving mechanism further comprises a plurality of second pulleys mounted in said receiving space of said movable plate such that said one end of said traction cable is wound on said second pulleys.

8. The exercise machine as defined in claim 1, wherein said grip member is a rod.

9. The exercise machine as defined in claim 1, wherein said grip member is a circular strap.

* * * * *